US007494217B2

(12) United States Patent
Jongebloed, Jr.

(10) Patent No.: US 7,494,217 B2
(45) Date of Patent: Feb. 24, 2009

(54) MAGNETIC EYEGLASS HOLDER

(75) Inventor: James T. Jongebloed, Jr., Houston, TX (US)

(73) Assignee: Gripping Eyewear, Inc., Houston, TX (US)

( * ) Notice: Subject to any disclaimer, the term of this patent is extended or adjusted under 35 U.S.C. 154(b) by 287 days.

(21) Appl. No.: 11/566,872

(22) Filed: Dec. 5, 2006

(65) Prior Publication Data

US 2008/0105798 A1 May 8, 2008

Related U.S. Application Data

(60) Provisional application No. 60/864,502, filed on Nov. 6, 2006.

(51) Int. Cl.
*G02C 1/00* (2006.01)
*A47G 1/17* (2006.01)

(52) U.S. Cl. ..... 351/158; 248/309.4; 248/902; 211/85.1

(58) Field of Classification Search ..... 351/41, 351/158; 248/309.1, 309.4, 310, 902; 211/13.1; 223/85, 88; 40/642.02, 649, 651, 661.01; 24/3.1, 3.8

See application file for complete search history.

(56) References Cited

U.S. PATENT DOCUMENTS

| | | | | |
|---|---|---|---|---|
| 4,878,641 | A | 11/1989 | Vogt | |
| D305,340 | S | 1/1990 | Stein | |
| 4,941,634 | A | 7/1990 | Gomes et al. | |
| 5,137,242 | A | 8/1992 | Reath | |
| 5,316,252 | A | 5/1994 | Charnow et al. | |
| D379,871 | S | 6/1997 | Hollinger | |
| 5,921,409 | A * | 7/1999 | Gerber et al. | 211/85.1 |
| 6,135,407 | A | 10/2000 | Havis et al. | |
| 6,367,126 | B1 | 4/2002 | Rivkin | |
| D466,292 | S | 12/2002 | Hulback et al. | |
| 6,568,805 | B1 | 5/2003 | Dietz | |
| 6,848,787 | B2 | 2/2005 | Dietz | |

* cited by examiner

*Primary Examiner*—Huy K Mai
(74) *Attorney, Agent, or Firm*—Fulbright & Jaworski L.L.P.

(57) ABSTRACT

The invention is directed to a magnetic eyeglasses holder that includes a support and a magnet. The support includes an upright member and a base. The magnet allows for attractive magnetic communication with at least one temple bar of an eyeglasses such that when folded the eyeglasses are held in place on the holder. The magnet can be positioned at least partially within at least one recess in the upright member or on the surface of the upright member. The magnet can be fixed or removably positioned in at least one recess and/or the surface of the upright member.

22 Claims, 3 Drawing Sheets

MAGNETIC EYEGLASS HOLDER

CROSS REFERENCE TO RELATED APPLICATIONS

This application claims priority to Provisional Application No. 60/864,502 filed Nov. 6, 2006 which is incorporated in its entirety.

TECHNICAL FIELD

The present invention is directed to eyeglasses holders and more particularly to magnetic eyeglass holders.

BACKGROUND OF THE INVENTION

Typical eyeglasses consist of a frame body that houses two lenses on either side of a nose piece. Attached to the frame body are two temple bars that extend from two ends of the frame body. The temple bars pivot between an open position perpendicular with the frame body and a closed position parallel with the frame body. Sometimes attached to the temple bars are separate ear pieces, or temple tips. The temple bars and nose piece support the frame on the head of the wearer.

Individuals often remove their eyeglasses during the course of the day. They may hang them around their neck where they bounce against their chest, they may put them in a pocket and have them fall out or they may put them in a place where they can get damaged. Especially when individuals go to bed at night, they may put down their eyeglasses somewhere and not recall where the next morning when they need them.

To solve this problem, the prior art teaches a variety of eyeglass holders, including stand-alone and eyeglass holders which are fixed to a solid surface. However, unlike the present invention, none of these eyeglass holders include a magnetic means of holding the eyeglasses.

The use of magnets on eyeglass frames for various purposes is also well known in the art. For example, a number of eyeglass frames have magnets that magnetize the wearer for health benefits. Other eyeglass frames use magnets to hold eyeglass frame sections together, thereby facilitating disassembly and reassembly in a new configuration, with auxiliary frames, lenses, or the like.

BRIEF SUMMARY OF THE INVENTION

Embodiments of the present invention are directed to a magnetic eyeglasses holder that includes a support having a first attractive means. The support is operable to maintain its intended upright position when placed on a flat surface. The first attractive means allows for attractive magnetic communication with each temple bar of an eyeglasses such that when folded the eyeglasses are held in place on the holder.

In some embodiments, the support includes an upright member and a base. The first attractive means is positioned on or at least partially in the upright member. The support can be a stand.

In some embodiments, the first attractive means is a magnet. Additionally or alternatively, the first attractive means is formed from non-magnetic ferrous material.

Embodiments of the present invention are also directed to a magnetic eyeglasses holder that includes a support having an upright member and a base, and at least one magnet positioned on or at least partially in the upright member. The at least one magnet allows for attractive magnetic communication with each temple bar of an eyeglasses such that when folded the eyeglasses are held in place on the holder.

In some embodiments, the support is operable to maintain its intended upright position when the base is placed on a flat surface. The support may include at least one suction cup for securely attaching to the flat surface.

In some embodiments, the magnet is positioned at least partially within at least one recess in the upright member. The magnet can be fixed in a recess or removably held in the recess. The magnet can be removably held in the recess by any means. For example, the magnet can be removably in the recess by magnetic attraction. Additionally or alternatively, the upright member can include at least one aperture in the recess and the magnet can include at least one outwardly extending projection that is insertable through the aperture.

In other embodiments, the magnet is positioned on the surface of the upright member and extends outwardly from the upright member. The magnet can be fixed on the surface of the upright member or removably held on the surface of the upright member.

In other embodiments, the magnet extends through the upright member providing for attractive magnetic communication on both sides of the upright member.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1A:
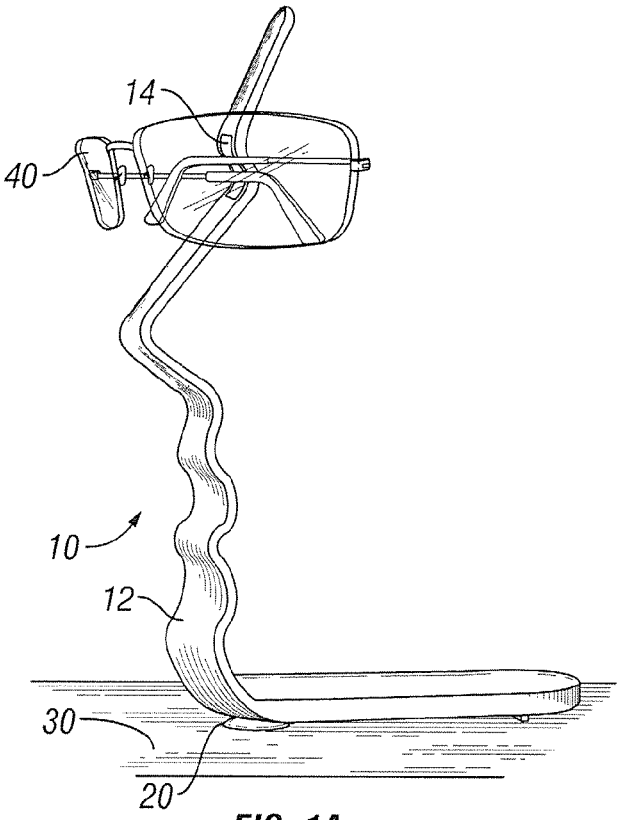
FIG. 1A is a perspective view of a magnetic eyeglasses holder according to an embodiment of the present invention.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIGS. 1-5 illustrate embodiments of eyeglasses holder 10 comprising support 12 and first attractive means 14 for holding a set of eyeglasses. It should be appreciated that embodiments of eyeglasses holder 10 covered by the present invention can include more than one attractive means.

As shown in FIG. 1A, first attractive means 14 attracts and holds eyeglasses 40. First attractive means 14 can be any size or shape suitable for positioning on or at least partially in support 12. Non-limiting examples of suitable shapes include rectangular, square, circular, oval, and hexagonal. First attractive means 14 can be composed of a magnetic material or a non-magnetic ferrous material. A magnetic material allows for attractive communication with eyeglasses which contain at least one magnet and/or a metal or a combination of metals in at least a portion of the eyeglasses. The at least one magnet and/or the metal or combination of metals can be included in and/or on a temple bar of the eyeglasses such that when folded the eyeglasses are held in place on eyeglasses holder 10. Through the attraction between first attractive means 14 and the at least one magnet and/or the metal or the combination of metals contained in eyeglasses 40, eyeglasses holder 10 may hold eyeglasses 40. A non-magnetic ferrous material allows for attractive magnetic communication with eyeglasses which contain at least one magnet in at least a portion of the eyeglasses. The at least one magnet can be included in and/or on a temple bar of the eyeglasses such that when folded the eyeglasses are held in place on eyeglasses holder 10. Through the attraction between first attractive means 14 and the at least one magnet contained in eyeglasses 40, eyeglasses holder 10 may hold eyeglasses 40.

Figure 1B:
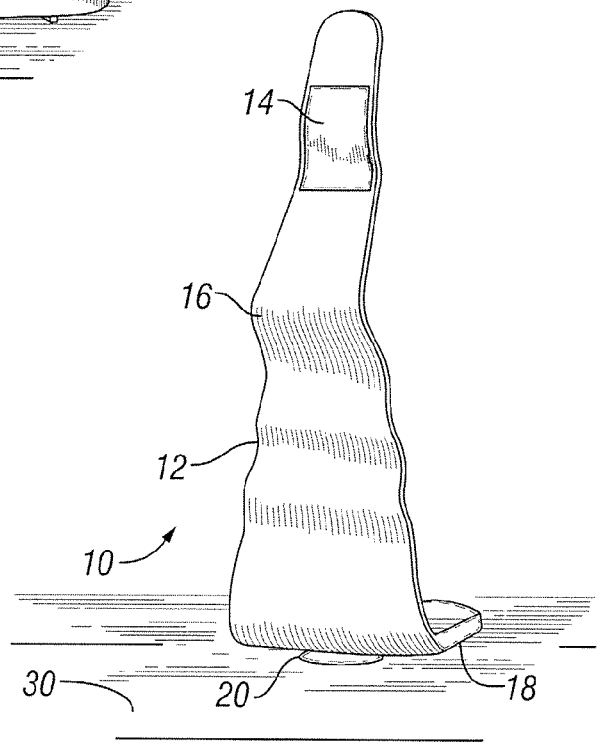
FIG. 1B is a perspective view of a magnetic eyeglasses holder according to another embodiment of the present invention.
Figure 2:
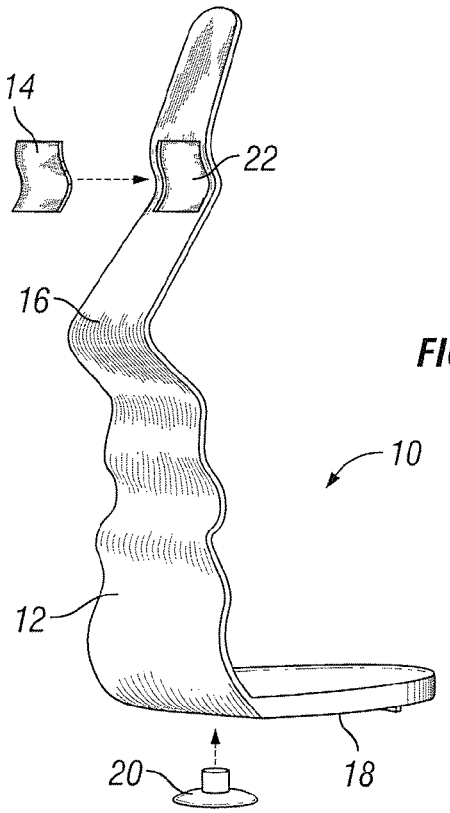
FIG. 2 is a perspective view of a magnetic eyeglasses holder according to another embodiment of the present invention.
Figure 3:
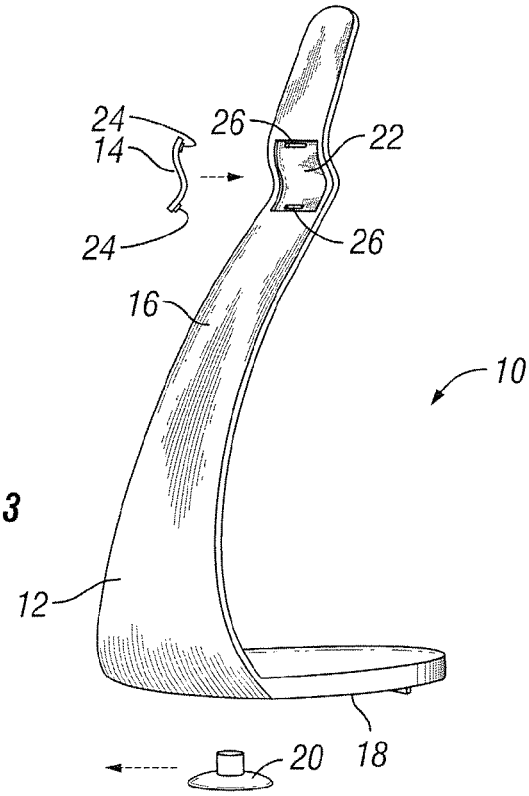
FIG. 3 is a perspective view of a magnetic eyeglasses holder according to another embodiment of the present invention.

Support 12 is operable to maintain its intended upright position when placed on flat surface 30 as shown in FIGS. 1A and 1B. As shown in FIGS. 1-3, support 12 may further comprise suction cup 20 for securely attaching to a flat surface. Suction cup 20 assists support 12 to maintain an upright position on flat surface 30, as shown in FIGS. 1A and 1B.

Figure 4:
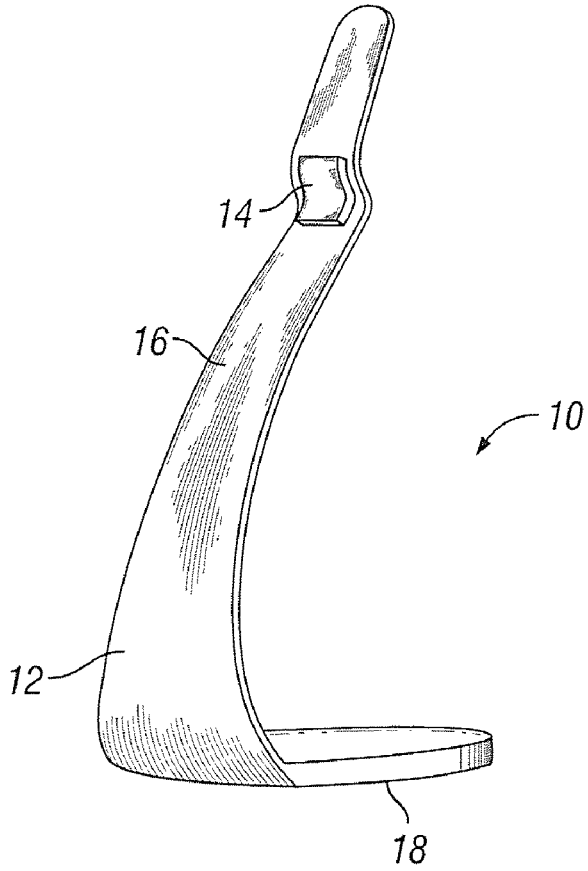
FIG. 4 is a perspective view of a magnetic eyeglasses holder according to another embodiment of the present invention.
Figure 5:
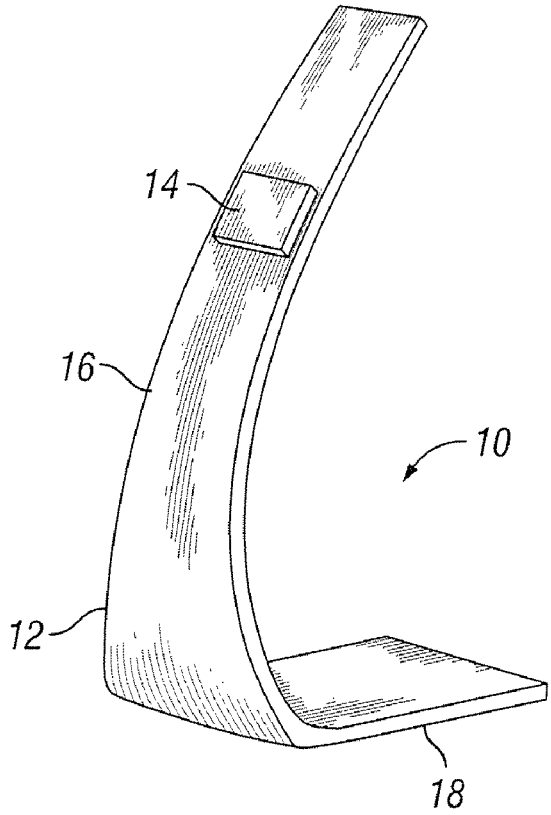
FIG. 5 is a perspective view of a magnetic eyeglasses holder according to another embodiment of the present invention.

As shown in FIGS. 1B and 2-5, support 12 may comprise upright member 16 and base 18. Suction cup 20 is preferably positioned at the bottom of base 18, as shown in FIGS. 2 and 3. Upright member 16 can be composed of any suitable material known in the art. Non-limiting examples of suitable materials are metal, plastic, glass, wood, stone, ceramic or combinations thereof. Preferably, upright member 16 is composed of metal or a combination of metals, such as stainless steel. Although upright member 16 can be any size or shape, upright members having simple, basic shapes, such as those illustrated in FIGS. 3-5, are preferred because these shapes are easily manufactured. However, upright member 16 can be shaped to resemble more complex objects, such as the profile of the human face as shown in FIGS. 1B and 2, for aesthetic purposes if desired.

Base 18 can be composed of any suitable material known in the art. Non-limiting examples of suitable materials are metal, plastic, glass, wood, stone, ceramic or combinations thereof. Preferably, base 18 is composed of metal or a combination of metals, such as stainless steel. Although base 18 can be any size or shape, base 18 is preferably shaped such that it is functional to maintain itself as well as upright member 16 upright when support 12 is placed on flat surface 30, as shown in FIG. 1B.

In preferred embodiments of the present invention, first attractive means 14 comprises a magnetic material, such as nyobium. As shown in FIGS. 1B, 2 and 3, magnet 14 can be positioned at least partially within a recess of upright member 16. Magnet 14 can be fixed in recess 22 as shown in FIGS. 1A and 1B such that magnet 14 is not removable from recess 22. Magnet 14 can be fixed in recess 22 employing any suitable means known in the art, such as by the use of adhesives or welding.

Alternatively, magnet 14 can be removably positioned at least partially within recess 22 as shown in FIGS. 2 and 3. Magnet 14 can be removably held in recess 22 via the magnetic attraction between magnet 14 and the metal or combinations of metals recess 22 is at least partially made of, as shown in FIG. 2. As shown in FIG. 3, magnet 14 can be removably held in recess 22 by inserting outwardly extending members 24 of magnet 14 into apertures 26 of recess 22. In embodiments where recess 22 comprises metal or a combination of metals, magnet 14 would additionally be held in recess 22 by magnetic attraction. Other methods such as friction fit, Velcro, and wax can be used.

Magnet 14 of embodiments of the present invention can extend through upright member 16. In this way, magnet 14 can attract and hold a first set of eyeglasses on one side of upright member 16 and a second set of eyeglasses on the other side of upright member 16. There can also be more than one magnet 14 that extends through upright member 16 so that more than two sets of eyeglasses may be held by eyeglasses holder 10.

As shown if FIGS. 4 and 5, magnet 14 can be positioned on the surface of upright member 16. Magnet 14 can be fixed on the surface of upright member 16 such that magnet 14 is not removable from the surface of upright member 16. Magnet 14 can be fixed employing any suitable means known in the art, such as by the use of adhesives or welding.

Alternatively, magnet 14 can be removably positioned on the surface of upright member 16 by any suitable means known in the art. For example, magnet 14 can be removably held on the surface of upright member 16 via the magnetic attraction between magnet 14 and the metal or combinations of metals upright member 16 is at least partially made of.

Additionally or alternatively, other methods such as clip in place, snap in place, friction fit, Velcro, and wax can be used.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A magnetic eyeglasses holder comprising:

a support having an upright member and a base; and at least a first attractive means positioned on or at least partially in the upright member, wherein the at least first attractive means allows for attractive magnetic communication with each temple bar of an eyeglasses such that when folded the eyeglasses are held in place on the holder.

2. The holder of claim 1, wherein the support is operable to maintain its intended upright position when the base is placed on a flat surface.

3. The holder of claim 2, wherein the base comprises at least one suction cup for securely attaching to the flat surface.

4. The holder of claim 1, wherein the upright member is shaped like the profile of a human face.

5. The holder of claim 1, wherein the first attractive means is positioned at least partially within at least one recess in the upright member.

6. The holder of claim 5, wherein the first attractive means is fixed in the recess.

7. The holder of claim 5, wherein the first attractive means is removably held in the recess.

8. The holder of claim 7, wherein the first attractive means is held in the recess by magnetic attraction.

9. The holder of claim 5, wherein the upright member comprises at least one aperture in the recess and the first attractive means comprises at least one projection extending outwardly from the first attractive means, the projection insertable through the aperture.

10. The holder of claim 1, wherein the first attractive means is positioned on the surface of the upright member and extends outwardly from the upright member.

11. The holder of claim 10, wherein the first attractive means is fixed on the surface of the upright member.

12. The holder of claim 10, wherein the first attractive means is removably held on the surface of the upright member.

13. The holder of claim 1, wherein the first attractive means extends through the upright member providing for attractive magnetic communication on both sides of the upright member.

14. The holder of claim 1, wherein the first attractive means is composed of a magnetic material or a non-magnetic ferrous material.

15. A magnetic eyeglasses holder comprising:

a stand; and at least one attractive means held on or at least partially in the stand, wherein the at least one attractive means allows for attractive magnetic communication with each temple bar of an eyeglasses such that when folded the eyeglasses are held in place on the holder.

16. The holder of claim 15, wherein the stand is operable to maintain its intended upright position when placed on a flat surface.

17. The holder of claim 16, wherein the attractive means is positioned at least partially within at least one recess in the stand.

18. A magnetic eyeglasses holder comprising:

a support including a first attractive means;

wherein the support is operable to maintain its intended upright position when placed on a flat surface; and wherein the first attractive means allows for attractive magnetic communication with attractive means on each temple bar of an eyeglasses such that when folded the eyeglasses are held in place on the holder.

19. The holder of claim 18, wherein the first attractive means is a magnet.

20. The holder of claim 18, wherein the first attractive means is formed from non-magnetic ferrous material.

21. The holder of claim 18, wherein the support comprises a vertical member and a base.

22. The holder of claim 21, wherein the first attractive means is positioned on or at least partially in the vertical member.

* * * * *